US011466909B2

(12) United States Patent
Lesmerises et al.

(10) Patent No.: US 11,466,909 B2
(45) Date of Patent: Oct. 11, 2022

(54) REFRIGERATION SYSTEM AND METHOD FOR OPERATING SAME

(71) Applicant: Marc-André Lesmerises, Trois-Rivières (CA)

(72) Inventors: Marc-André Lesmerises, Trois-Rivières (CA); Tommy Dolbec, Bastican (CA)

(73) Assignee: Marc-André Lesmerises, Trois-Rivières (CA)

( * ) Notice: Subject to any disclaimer, the term of this patent is extended or adjusted under 35 U.S.C. 154(b) by 227 days.

(21) Appl. No.: 16/325,672

(22) PCT Filed: Aug. 17, 2017

(86) PCT No.: PCT/CA2017/050974

§ 371 (c)(1),
(2) Date: Feb. 14, 2019

(87) PCT Pub. No.: WO2018/032108

PCT Pub. Date: Feb. 22, 2018

(65) Prior Publication Data

US 2019/0203993 A1 Jul. 4, 2019

Related U.S. Application Data

(60) Provisional application No. 62/375,931, filed on Aug. 17, 2016.

(51) Int. Cl.
*F25B 47/02* (2006.01)
*F25B 41/00* (2021.01)
(Continued)

(52) U.S. Cl.
CPC ..... *F25B 47/02* (2013.01); *F25B 1/10* (2013.01); *F25B 9/008* (2013.01); *F25B 41/00* (2013.01);
(Continued)

(58) Field of Classification Search
CPC .... F25B 47/02; F25B 47/022; F25B 2347/02; F25B 2347/022; F25B 41/00; F25B 9/008;
(Continued)

(56) References Cited

U.S. PATENT DOCUMENTS 4,139,356 A * 2/1979 Hattori ..... F25B 47/022 62/278
7,757,514 B2 * 7/2010 Oshitani ..... F25B 47/02 62/500
(Continued)

FOREIGN PATENT DOCUMENTS

CA 2 921 146 A1 4/2010

OTHER PUBLICATIONS

Nov. 21, 2017 ISR for PCT/CA2017/050974.
(Continued)

*Primary Examiner* — Tavia Sullens
(74) *Attorney, Agent, or Firm* — Hahn Loeser & Parks LLP

(57) ABSTRACT

A refrigeration system operable in cooling mode and defrosting mode is provided. The refrigeration system includes a defrost line connecting a first reservoir to an evaporation stage for conveying at least part of the flash gas from the first reservoir to the evaporation stage when the refrigeration system is operating in defrosting mode. The flash gas thereby releases heat in the evaporation stage for defrosting the evaporation stage. The refrigeration system can also include a discharge line connecting the evaporation stage to a second reservoir.

14 Claims, 6 Drawing Sheets

(51) Int. Cl.
*F25B 9/00* (2006.01)
*F25B 1/10* (2006.01)

(52) U.S. Cl.
CPC . *F25B 2341/0012* (2013.01); *F25B 2347/022* (2013.01); *F25B 2400/0411* (2013.01); *F25B 2400/0415* (2013.01); *F25B 2400/05* (2013.01)

(58) Field of Classification Search
CPC .. F25B 9/08; F25B 2341/00; F25B 2341/001; F25B 2341/0011; F25B 2341/0012
See application file for complete search history.

(56) References Cited

U.S. PATENT DOCUMENTS

| | | | | |
|---|---|---|---|---|
| 2007/0271942 | A1* | 11/2007 | Yokoyama | F25B 47/02 62/278 |
| 2008/0041079 | A1 | 2/2008 | Nishijima et al. | |
| 2012/0167601 | A1* | 7/2012 | Cogswell | F25B 41/043 62/115 |
| 2014/0352343 | A1 | 4/2014 | Hinde et al. | |
| 2018/0328638 | A1* | 11/2018 | Mahmoud | F25B 41/00 |

OTHER PUBLICATIONS

Nov. 21, 2017 Written Opinion of Int'l Searching Authority for PCT/CA2017/050974.
Nov. 23, 2018 Int'l Preliminary Report on Patentability for PCT/CA2017/050974.

* cited by examiner

REFRIGERATION SYSTEM AND METHOD FOR OPERATING SAME

TECHNICAL FIELD

The technical field generally relates to refrigeration systems and to a method for operating a refrigeration system. More particularly, the invention relates to the defrost cycle of refrigeration systems, and to a method for operating the refrigeration systems in defrosting mode.

BACKGROUND

In the last few years, carbon dioxide ($CO_2$) made a come-back in refrigeration applications where it is used as a refrigerant fluid or coolant. This is mainly due to the concerns regarding the effects of refrigerants on ozone layer depletion and global warming. $CO_2$ is known as a naturally available, safe, environmental friendly refrigerant with good thermo-physical and transport properties. $CO_2$ refrigeration may be used in many applications, such as for ensuring proper storage temperature of food products. However, as with most other refrigerants, a certain build-up of ice may occur at the surface of the evaporator during the cooling cycle. It is generally desirable to remove this build-up of ice (i.e., defrosting).

Various techniques for defrosting refrigeration systems are known. For example, a common method for defrosting refrigeration systems is to stop the refrigeration cycle and let the frost melt on its own (i.e., a passive defrosting). However, this method is generally time consuming and inefficient. Another example is to stop the refrigeration cycle and activate heaters placed near the evaporator. However, this method can be time and energy consuming, and can cause undesirable heating of the refrigerated area. Yet another method for defrosting refrigeration systems is to circulate hot refrigerant vapor from the compressor, through the evaporator. This method can also be energy consuming and can also lead to the introduction of some liquid refrigerant being introduced into the compressor, which may damage the compressor.

In view of the above, operating a refrigeration system with cooling and/or defrosting modes still has a number of challenges.

SUMMARY

It is therefore an aim of the present invention to address at least one of the above mentioned issues.

In some embodiments, there is provided a $CO_2$ refrigeration system operable in cooling mode and defrosting mode, the $CO_2$ refrigeration system including: a compression stage in which $CO_2$ refrigerant is compressed; a cooling stage in which the compressed $CO_2$ refrigerant releases heat; a reservoir downstream of the cooling stage for storing the $CO_2$ refrigerant; an evaporation stage in which the $CO_2$ refrigerant, having released heat in the cooling stage, absorbs heat when the $CO_2$ refrigeration system is operating in cooling mode; transfer lines connecting the compression stage, the cooling stage, the reservoir and the evaporation stage, and wherein the $CO_2$ refrigerant is circulable in a closed-loop circuit; a defrost line connecting the reservoir to the evaporation stage for conveying a first portion of the refrigerant from the reservoir to the evaporation stage when the $CO_2$ refrigeration system is operating in defrosting mode, wherein the first portion of the $CO_2$ refrigerant releases heat in the evaporation stage for defrosting the evaporation stage; a defrost return line for conveying the $CO_2$ refrigerant having released heat in the evaporation stage from the evaporation stage to the reservoir; and a pressure regulating unit provided in the defrost return line, for pressurizing the $CO_2$ refrigerant having released heat in the evaporation stage.

In some embodiments, the $CO_2$ refrigerant is stored in the reservoir as liquid refrigerant and flash gas.

In some embodiments, the first portion of the $CO_2$ refrigerant conveyed from the reservoir to the evaporation stage when the $CO_2$ refrigeration system is operating in defrosting mode, includes at least part of the flash gas.

In some embodiments, the system further includes a transfer line for conveying a second portion of the $CO_2$ refrigerant from the reservoir to the compression stage, when the $CO_2$ refrigeration system is operating in defrosting mode.

In some embodiments, the pressure regulating unit is an ejector having a nozzle section, a suction section and a pressurizing section, wherein the $CO_2$ refrigerant having released heat in the evaporation stage enters the ejector via the suction section and exits the ejector via the pressurizing section.

In some embodiments, the system further includes an ejector input line for conveying compressed and cooled $CO_2$ refrigerant from the cooling stage to the nozzle section of the ejector when the $CO_2$ refrigeration system is operating in defrosting mode.

In some embodiments, there is provided a method for defrosting a $CO_2$ refrigeration system, the $CO_2$ refrigeration system including: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat when the $CO_2$ refrigeration system is operating in cooling mode; and a reservoir downstream of the cooling stage for storing $CO_2$ refrigerant, the method including: discharging a first portion of the $CO_2$ refrigerant from the reservoir to the evaporation stage in order to defrost the evaporation stage by releasing heat in the evaporation stage; and pressurizing at least a portion of the $CO_2$ refrigerant having released heat in the evaporation stage; and conveying the pressurized $CO_2$ refrigerant back to the reservoir.

In some embodiments, the method further includes conveying a second portion of the $CO_2$ refrigerant from the reservoir to the compression stage.

In some embodiments, the method further includes exchanging heat between the first portion of the $CO_2$ refrigerant from the reservoir and the compressed second portion of the $CO_2$ refrigerant exiting the compression stage.

In some embodiments, the pressurizing is performed using an ejector having a nozzle section, a suction section and a pressurizing section, wherein the $CO_2$ refrigerant having released heat in the evaporation stage enters the ejector via the suction section and exits the ejector via the pressurizing section, and wherein compressed and cooled $CO_2$ refrigerant from the cooling stage enters the ejector via the nozzle section.

In some embodiments, there is provided a $CO_2$ refrigeration system operable in cooling mode and defrosting mode, the $CO_2$ refrigeration system including: a compression stage in which $CO_2$ refrigerant is compressed; a cooling stage in which the compressed $CO_2$ refrigerant releases heat; a reservoir downstream of the cooling stage for storing the $CO_2$ refrigerant; an evaporation stage in which the $CO_2$ refrigerant, having released heat in the cooling stage, absorbs heat when the $CO_2$ refrigeration system is operating in cooling mode; refrigerant transfer lines connecting the compression stage, the cooling stage, the reservoir and the evaporation stage, and wherein the $CO_2$ refrigerant is circulable in a closed-loop circuit; a defrost line connecting the reservoir to the evaporation stage for conveying at least a portion of the $CO_2$ refrigerant from the reservoir to the evaporation stage when the $CO_2$ refrigeration system is operating in defrosting mode, wherein the refrigerant releases heat in the evaporation stage for defrosting the evaporation stage; and a discharge line connecting the evaporation stage to the compression stage.

In some embodiments, the $CO_2$ refrigerant is stored in the reservoir as liquid refrigerant and flash gas.

In some embodiments, the at least a portion of the $CO_2$ refrigerant conveyed from the reservoir to the evaporation stage when the refrigeration system is operating in defrosting mode includes at least part of the flash gas.

In some embodiments, the system further includes a second reservoir downstream of the evaporation stage for storing the $CO_2$ refrigerant.

In some embodiments, the discharge line connects the evaporation stage to the compression stage via the second reservoir.

In some embodiments, the discharge line conveys a first portion of the refrigerant having released heat in the evaporation stage to the second reservoir.

In some embodiments, the first portion of the $CO_2$ refrigerant having released heat in the evaporation stage is all of the refrigerant having released heat in the evaporation stage.

In some embodiments, the system further includes: a refrigerant return line for conveying a second portion of the $CO_2$ refrigerant having released heat in the evaporation stage from the evaporation stage to the reservoir; and a pressure regulating unit provided in the refrigerant return line, for pressurizing the second portion of the $CO_2$ refrigerant having released heat in the evaporation stage.

In some embodiments, the pressure regulating unit is an ejector having a nozzle section, a suction section and a pressurizing section, wherein the second portion of the $CO_2$ refrigerant having released heat in the evaporation stage enters the ejector via the suction section and exits the ejector via the pressurizing section.

In some embodiments, the system further includes an ejector input line for conveying compressed and cooled $CO_2$ refrigerant from the cooling stage to the nozzle section of the ejector when the $CO_2$ refrigeration system is operating in defrosting mode.

In some embodiments, the cooling stage includes a heat-exchange unit in which the $CO_2$ refrigerant of the defrost line absorbs heat from the compressed $CO_2$ refrigerant when the $CO_2$ refrigeration system is operating in defrosting mode.

In some embodiments, there is provided a method for defrosting a $CO_2$ refrigeration system, the $CO_2$ refrigeration system including: a cooling stage in which a $CO_2$ refrigerant releases heat; an evaporation stage in which the $CO_2$ refrigerant, having released heat in the cooling stage, absorbs heat when the $CO_2$ refrigeration system is operating in cooling mode; a reservoir downstream of the cooling stage for storing the $CO_2$ refrigerant; and a compression stage downstream of the evaporation stage, in which the $CO_2$ refrigerant is compressed, the method including: setting a first pressure in the reservoir, and a second pressure downstream of the evaporation stage, wherein the first pressure is higher than the second pressure; conveying at least a portion of the $CO_2$ refrigerant from the reservoir to the evaporation stage in order to defrost the evaporation stage by releasing heat in the evaporation stage; and conveying at least a first portion of the $CO_2$ refrigerant having released heat in the evaporation stage to the compression stage.

In some embodiments, the method further includes exchanging heat between the at least a portion of the $CO_2$ refrigerant from the reservoir and compressed $CO_2$ refrigerant exiting the compression stage.

In some embodiments, the method further includes: conveying a second portion of the $CO_2$ refrigerant having released heat in the evaporation stage from the evaporation stage to the compression stage; and pressurizing the second portion of the $CO_2$ refrigerant having released heat in the evaporation stage.

In some embodiments, there is provided a $CO_2$ refrigeration system operable in cooling mode and heating mode, the $CO_2$ refrigeration system including: a compression stage in which $CO_2$ refrigerant is compressed; a cooling stage in which the compressed $CO_2$ refrigerant releases heat; a reservoir downstream of the cooling stage for storing the $CO_2$ refrigerant; an evaporation stage in which the $CO_2$ refrigerant, having released heat in the cooling stage, absorbs heat when the $CO_2$ refrigeration system is operating in cooling mode; transfer lines connecting the compression stage, the cooling stage, the reservoir, and the evaporation stage, and wherein the $CO_2$ refrigerant is circulable in a closed-loop circuit; a heating line connecting the reservoir to the evaporation stage for conveying at least a portion of the $CO_2$ refrigerant from the reservoir to the evaporation stage when the $CO_2$ refrigeration system is operating in heating mode, wherein the $CO_2$ refrigerant releases heat in the evaporation stage for heating the evaporation stage; and a discharge line connecting the evaporation stage to the compression stage.

In some embodiments, the $CO_2$ refrigerant is stored in the reservoir as liquid refrigerant and flash gas.

In some embodiments, the at least a portion of the $CO_2$ refrigerant conveyed from the reservoir to the evaporation stage when the $CO_2$ refrigeration system is operating in defrosting mode includes at least part of the flash gas.

In some embodiments, the system further includes a second reservoir downstream of the evaporation stage for storing the $CO_2$ refrigerant exiting the evaporation stage.

In some embodiments, there is provided a method for heating a $CO_2$ refrigeration system, the $CO_2$ refrigeration system including: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat when the $CO_2$ refrigeration system is operating in cooling mode; a reservoir downstream of the cooling stage for storing $CO_2$ refrigerant, the method including: setting a first pressure in the reservoir, and a second pressure in downstream of the evaporation stage, wherein the first pressure is higher than the second pressure; conveying at least a portion of the $CO_2$ refrigerant from the reservoir to the evaporation stage in order to heat the evaporation stage by releasing heat from the $CO_2$ refrigerant in the evaporation stage; and conveying at least a first portion of the $CO_2$ refrigerant having released heat in the evaporation stage to the compression stage.

In some embodiments, there is provided a $CO_2$ refrigeration system operable in cooling mode and heating mode, the $CO_2$ refrigeration system including: a compression stage in which $CO_2$ refrigerant is compressed; a cooling stage in which the compressed $CO_2$ refrigerant releases heat; a reservoir downstream of the cooling stage for storing the $CO_2$ refrigerant as liquid refrigerant and flash gas; an evaporation stage in which the $CO_2$ refrigerant, having released heat in the cooling stage, absorbs heat when the $CO_2$ refrigeration system is operating in cooling mode; transfer lines connecting the compression stage, the cooling stage, the reservoir and the evaporation stage, and wherein the $CO_2$ refrigerant is circulable in a closed-loop circuit; a heating line connecting the reservoir to the evaporation stage for conveying a first portion of the flash gas from the reservoir to the evaporation stage when the $CO_2$ refrigeration system is operating in heating mode, wherein the first portion of the flash gas releases heat in the evaporation stage for heating the evaporation stage; a flash gas heat return line for conveying the flash gas having released heat in the evaporation stage from the evaporation stage to the reservoir; and a pressure regulating unit provided in the flash gas heat return line, for pressurizing the flash gas having released heat in the evaporation stage.

In some embodiments, there is provided method for heating a $CO_2$ refrigeration system, the $CO_2$ refrigeration system including: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat when the $CO_2$ refrigeration system is operating in cooling mode; and a reservoir downstream of the cooling stage for storing $CO_2$ refrigerant as liquid $CO_2$ refrigerant and flash gas, the method including: discharging a first portion of the flash gas from the reservoir to the evaporation stage in order to heat the evaporation stage by releasing heat in the evaporation stage; and pressurizing at least a portion of the flash gas having released heat in the evaporation stage; and conveying the pressurized flash gas back to the $CO_2$ reservoir.

In some embodiments, conveying at least a portion of the $CO_2$ refrigerant from the reservoir to the evaporation stage in order to heat the evaporation stage by releasing heat in the evaporation stage defrosts the evaporation stage.

In some embodiments, discharging a first portion of the flash gas from the reservoir to the evaporation stage in order to heat the evaporation stage by releasing heat from the $CO_2$ refrigerant in the evaporation stage defrosts the evaporation stage.

In some embodiments, there is provided a refrigeration system operable in cooling mode and defrosting mode, the refrigeration system including: a compression stage in which a refrigerant is compressed; a cooling stage in which the compressed refrigerant releases heat; a reservoir downstream of the cooling stage for storing the refrigerant; an evaporation stage in which the refrigerant, having released heat in the cooling stage, absorbs heat when the refrigeration system is operating in cooling mode; transfer lines connecting the compression stage, the cooling stage, the reservoir and the evaporation stage, and wherein the refrigerant is circulable in a closed-loop circuit; a defrost line connecting the reservoir to the evaporation stage for conveying a first portion of the refrigerant from the reservoir to the evaporation stage when the refrigeration system is operating in defrosting mode, wherein the first portion of the refrigerant releases heat in the evaporation stage for defrosting the evaporation stage; and a defrost return line for conveying the refrigerant having released heat in the evaporation stage from the evaporation stage to the reservoir; and a pressure regulating unit provided in the defrost return line, for pressurizing the refrigerant having released heat in the evaporation stage.

In some embodiments, the refrigerant is stored in the reservoir as liquid refrigerant and flash gas.

In some embodiments, the first portion of the refrigerant conveyed from the reservoir to the evaporation stage when the refrigeration system is operating in defrosting mode, includes at least part of the flash gas.

In some embodiments, the system further includes a transfer line for conveying a second portion of the refrigerant from the reservoir to the compression stage, when the refrigeration system is operating in defrosting mode.

In some embodiments, the pressure regulating unit is an ejector having a nozzle section, a suction section and a pressurizing section, wherein the refrigerant having released heat in the evaporation stage enters the ejector via the suction section and exits the ejector via the pressurizing section.

In some embodiments, the system further includes an ejector input line for conveying compressed and cooled refrigerant from the cooling stage to the nozzle section of the ejector when the refrigeration system is operating in defrosting mode.

In some embodiments, there is provided a refrigeration system operable in cooling mode and defrosting mode, the refrigeration system including: a compression stage in which a refrigerant is compressed; a cooling stage in which the compressed refrigerant releases heat; a reservoir downstream of the cooling stage for storing the refrigerant; an evaporation stage in which the refrigerant, having released heat in the cooling stage, absorbs heat when the refrigeration system is operating in cooling mode; refrigerant transfer lines connecting the compression stage, the cooling stage, the reservoir and the evaporation stage, and wherein the refrigerant is circulable in a closed-loop circuit; a defrost line connecting the reservoir to the evaporation stage for conveying at least a portion of the refrigerant from the reservoir to the evaporation stage when the refrigeration system is operating in defrosting mode, wherein the refrigerant releases heat in the evaporation stage for defrosting the evaporation stage; and a discharge line connecting the evaporation stage to the compression stage.

In some embodiments, the refrigerant is stored in the reservoir as liquid refrigerant and flash gas.

In some embodiments, the at least a portion of the refrigerant conveyed from the reservoir to the evaporation stage when the refrigeration system is operating in defrosting mode includes at least part of the flash gas.

In some embodiments, the system further includes a second reservoir downstream of the evaporation stage for storing the refrigerant.

In some embodiments, the discharge line connects the evaporation stage to the compression stage via the second reservoir.

In some embodiments, the discharge line conveys a first portion of the refrigerant having released heat in the evaporation stage to the second reservoir.

In some embodiments, the first portion of the refrigerant having released heat in the evaporation stage is all of the refrigerant having released heat in the evaporation stage.

In some embodiments, the system further includes a refrigerant return line for conveying a second portion of the refrigerant having released heat in the evaporation stage from the evaporation stage to the reservoir; and a pressure regulating unit provided in the refrigerant return line, for pressurizing the second portion of the refrigerant having released heat in the evaporation stage.

In some embodiments, the pressure regulating unit is an ejector having a nozzle section, a suction section and a pressurizing section, wherein the second portion of the refrigerant having released heat in the evaporation stage enters the ejector via the suction section and exits the ejector via the pressurizing section.

In some embodiments, the system further includes an ejector input line for conveying compressed and cooled refrigerant from the cooling stage to the nozzle section of the ejector when the refrigeration system is operating in defrosting mode.

In some embodiments, the cooling stage includes a heat-exchange unit in which the refrigerant of the defrost line absorbs heat from the compressed refrigerant when the refrigeration system is operating in defrosting mode.

In some embodiments, there is provided a method for defrosting a refrigeration system, the refrigeration system including: a compression stage in which refrigerant is compressed; a cooling stage in which the refrigerant releases heat; an evaporation stage in which the refrigerant, having released heat in the cooling stage, absorbs heat when the refrigeration system is operating in cooling mode; and a reservoir downstream of the cooling stage for storing refrigerant, the method including: discharging a first portion of the refrigerant from the reservoir to the evaporation stage in order to defrost the evaporation stage by releasing heat in the evaporation stage; and pressurizing at least a portion of the refrigerant having released heat in the evaporation stage; and conveying the pressurized refrigerant back to the reservoir.

In some embodiments, there is provided a method for defrosting a refrigeration system, the refrigeration system including: a cooling stage in which a refrigerant releases heat; an evaporation stage in which the refrigerant, having released heat in the cooling stage, absorbs heat when the refrigeration system is operating in cooling mode; a reservoir downstream of the cooling stage for storing the refrigerant; and a compression stage downstream of the evaporation stage, in which the refrigerant is compressed, the method including: setting a first pressure in the reservoir, and a second pressure downstream of the evaporation stage, wherein the first pressure is higher than the second pressure; conveying at least a portion of the refrigerant from the reservoir to the evaporation stage in order to defrost the evaporation stage by releasing heat in the evaporation stage; and conveying at least a first portion of the refrigerant having released heat in the evaporation stage to the compression stage.

In some embodiments, the refrigerant includes $CO_2$.

In some embodiments, a $CO_2$ refrigeration system operable in cooling mode and defrosting mode is provided. The $CO_2$ refrigeration system includes: a compression stage in which $CO_2$ refrigerant is compressed; a cooling stage in which the compressed $CO_2$ refrigerant releases heat; a first $CO_2$ reservoir downstream of the cooling stage for storing $CO_2$ refrigerant as liquid $CO_2$ refrigerant and flash gas; an evaporation stage in which the $CO_2$ refrigerant, having released heat in the cooling stage, absorbs heat when the $CO_2$ refrigeration system is operating in cooling mode; a second $CO_2$ reservoir downstream of the evaporation stage for storing $CO_2$ refrigerant; $CO_2$ transfer lines connecting the compression stage, the cooling stage, the first $CO_2$ reservoir, the evaporation stage and the second $CO_2$ reservoir, and wherein the $CO_2$ refrigerant is circulable in a closed-loop circuit; a defrost line connecting the first $CO_2$ reservoir to the evaporation stage for conveying at least part of the flash gas from the first $CO_2$ reservoir to the evaporation stage when the $CO_2$ refrigeration system is operating in defrosting mode, wherein the flash gas releases heat in the evaporation stage for defrosting the evaporation stage; and a discharge line connecting the evaporation stage to the second $CO_2$ reservoir.

In some embodiments, the discharge line connecting the evaporation stage to the second $CO_2$ reservoir is for conveying a first portion of the flash gas having released heat in the evaporation stage to the second $CO_2$ reservoir.

In some embodiments, the cooling stage includes a heat-exchange unit in which the flash gas of the defrost line absorbs heat from the compressed $CO_2$ refrigerant when the $CO_2$ refrigeration system is operating in defrosting mode.

In some embodiments, the first portion of the flash gas having released heat in the evaporation stage is all of the flash gas having released heat in the evaporation stage.

In some embodiments, the $CO_2$ refrigeration system further includes: a flash gas return line for conveying a second portion of the flash gas having released heat in the evaporation stage from the evaporation stage to the first $CO_2$ reservoir; and a pressure regulating unit provided in the flash gas return line, for pressurizing the second portion of the flash gas having released heat in the evaporation stage.

In some embodiments, the pressure regulating unit is an ejector having a nozzle section, a suction section and a pressurizing section, wherein the second portion of the flash gas having released heat in the evaporation stage enters the ejector via the suction section and exits the ejector via the pressurizing section.

In some embodiments, the $CO_2$ refrigeration system further includes an ejector input line for conveying compressed and cooled $CO_2$ refrigerant from the cooling stage to the nozzle section of the ejector when the $CO_2$ refrigeration system is operating in defrosting mode.

In some embodiments, a method for defrosting a $CO_2$ refrigeration system is provided. The method includes: setting a first pressure of flash gas in the first $CO_2$ reservoir, and a second pressure of flash gas in the second $CO_2$ reservoir, wherein the first pressure is higher than the second pressure; conveying at least a portion of the flash gas from the first $CO_2$ reservoir to the evaporation stage in order to defrost the evaporation stage by releasing heat in the evaporation stage; and conveying at least a first portion of the flash gas having released heat in the evaporation stage to the second $CO_2$ reservoir.

In some embodiments, the method further includes exchanging heat between the at least a portion of the flash gas from the first $CO_2$ reservoir and compressed $CO_2$ refrigerant exiting the compression stage.

In some embodiments, the method further includes conveying a second portion of the flash gas having released heat in the evaporation stage from the evaporation stage to the first $CO_2$ reservoir; and pressurizing the second portion of the flash gas having released heat in the evaporation stage.

In some embodiments, a $CO_2$ refrigeration system operable in cooling mode and defrosting mode is provided. The $CO_2$ refrigeration system includes a compression stage in which $CO_2$ refrigerant is compressed; a cooling stage in which the compressed $CO_2$ refrigerant releases heat; a $CO_2$ reservoir downstream of the cooling stage for storing $CO_2$ refrigerant as liquid $CO_2$ refrigerant and flash gas; an evaporation stage in which the $CO_2$ refrigerant, having released heat in the cooling stage, absorbs heat when the $CO_2$ refrigeration system is operating in cooling mode; $CO_2$ transfer lines connecting the compression stage, the cooling stage, the $CO_2$ reservoir and the evaporation stage, and wherein the $CO_2$ refrigerant is circulable in a closed-loop circuit; a defrost line connecting the $CO_2$ reservoir to the evaporation stage for conveying a first portion of the flash gas from the $CO_2$ reservoir to the evaporation stage when the $CO_2$ refrigeration system is operating in defrosting mode, wherein the first portion of the flash gas releases heat in the evaporation stage for defrosting the evaporation stage; and a flash gas defrost return line for conveying the flash gas having released heat in the evaporation stage from the evaporation stage to the $CO_2$ reservoir; and a pressure regulating unit provided in the flash gas defrost return line, for pressurizing the flash gas having released heat in the evaporation stage.

In some embodiments, the system further includes a $CO_2$ transfer line for conveying a second portion of the flash gas from the $CO_2$ reservoir to the compression stage when the $CO_2$ refrigeration system is operating in defrosting mode.

In some embodiments, the pressure regulating unit is an ejector having a nozzle section, a suction section and a pressurizing section, wherein the flash gas having released heat in the evaporation stage enters the ejector via the suction section and exits the ejector via the pressurizing section.

In some embodiments, the system further includes an ejector input line for conveying compressed and cooled $CO_2$ refrigerant from the cooling stage to the nozzle section of the ejector when the $CO_2$ refrigeration system is operating in defrosting mode.

In some embodiments, a method for defrosting a $CO_2$ refrigeration system is provided. The $CO_2$ refrigeration system includes: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat when the $CO_2$ refrigeration system is operating in cooling mode; and a $CO_2$ reservoir downstream of the cooling stage for storing $CO_2$ refrigerant as liquid $CO_2$ refrigerant and flash gas, the method including: discharging at a first portion of the flash gas from the $CO_2$ reservoir to the evaporation stage in order to defrost the evaporation stage by releasing heat in the evaporation stage; and pressurizing at least a portion of the flash gas having released heat in the evaporation stage; and conveying the pressurized flash gas back to the $CO_2$ reservoir.

In some embodiments, the method includes conveying a second portion of the flash gas from the $CO_2$ reservoir to the compression stage. Optionally, the second portion of the flash gas can be all of the flash gas.

In some embodiments, the method further includes exchanging heat between the first portion of the flash gas from the $CO_2$ reservoir and the compressed second portion of the flash gas exiting the compression stage.

In some embodiments, the pressurizing is performed using an ejector having a nozzle section, a suction section and a pressurizing section, wherein the flash gas having released heat in the evaporation stage enters the ejector via the suction section and exits the ejector via the pressurizing section, and wherein compressed and cooled $CO_2$ refrigerant from the cooling stage enters the ejector via the nozzle section.

In some embodiments, a method for heating a $CO_2$ refrigeration system is provided. The $CO_2$ refrigeration system includes: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat when the $CO_2$ refrigeration system is operating in cooling mode; a first $CO_2$ reservoir downstream of the cooling stage for storing $CO_2$ refrigerant as liquid $CO_2$ refrigerant and flash gas; and a second $CO_2$ reservoir downstream of the evaporation stage. The method includes: setting a first pressure in the first $CO_2$ reservoir, and a second pressure in the second $CO_2$ reservoir, wherein the first pressure is higher than the second pressure; conveying at least a portion of the flash gas from the first $CO_2$ reservoir to the evaporation stage in order to heat the evaporation stage by releasing heat in the evaporation stage; and conveying at least a first portion of the flash gas having released heat in the evaporation stage to the second $CO_2$ reservoir.

In some embodiments, conveying at least a portion of the flash gas from the first $CO_2$ reservoir to the evaporation stage in order to heat the evaporation stage by releasing heat in the evaporation stage defrosts the evaporation stage.

In some embodiments, a method for heating a $CO_2$ refrigeration system, is provided the $CO_2$ refrigeration system including: a compression stage in which $CO_2$ refrigerant is compressed; a cooling stage in which the $CO_2$ refrigerant releases heat; an evaporation stage in which the $CO_2$ refrigerant, having released heat in the cooling stage, absorbs heat when the $CO_2$ refrigeration system is operating in cooling mode; and a $CO_2$ reservoir downstream of the cooling stage for storing $CO_2$ refrigerant as liquid $CO_2$ refrigerant and flash gas, the method including: discharging at a first portion of the flash gas from the $CO_2$ reservoir to the evaporation stage in order to heat the evaporation stage by releasing heat in the evaporation stage; and pressurizing at least a portion of the flash gas having released heat in the evaporation stage; and conveying the pressurized flash gas back to the $CO_2$ reservoir.

In some embodiments, discharging at a first portion of the flash gas from the $CO_2$ reservoir to the evaporation stage in order to heat the evaporation stage by releasing heat in the evaporation stage defrosts the evaporation stage.

In some embodiments, a $CO_2$ refrigeration system operable in cooling mode and heating mode is provided, the $CO_2$ refrigeration system including: a compression stage in which $CO_2$ refrigerant is compressed; a cooling stage in which the compressed $CO_2$ refrigerant releases heat; a first $CO_2$ reservoir downstream of the cooling stage for storing $CO_2$ refrigerant as liquid $CO_2$ refrigerant and flash gas; an evaporation stage in which the $CO_2$ refrigerant, having released heat in the cooling stage, absorbs heat when the $CO_2$ refrigeration system is operating in cooling mode; a second $CO_2$ reservoir downstream of the evaporation stage for storing $CO_2$ refrigerant; $CO_2$ transfer lines connecting the compression stage, the cooling stage, the first $CO_2$ reservoir, the evaporation stage and the second $CO_2$ reservoir, and wherein the $CO_2$ refrigerant is circulable in a closed-loop circuit; a heating line connecting the first $CO_2$ reservoir to the evaporation stage for conveying at least part of the flash gas from the first $CO_2$ reservoir to the evaporation stage when the $CO_2$ refrigeration system is operating in heating mode, wherein the flash gas releases heat in the evaporation stage for heating the evaporation stage; and a discharge line connecting the evaporation stage to the second $CO_2$ reservoir.

In some embodiments, the heating mode is a defrost mode.

In some embodiments, a $CO_2$ refrigeration system operable in cooling mode and heating mode is provided, the $CO_2$ refrigeration system including: a compression stage in which $CO_2$ refrigerant is compressed; a cooling stage in which the compressed $CO_2$ refrigerant releases heat; a $CO_2$ reservoir downstream of the cooling stage for storing $CO_2$ refrigerant as liquid $CO_2$ refrigerant and flash gas; an evaporation stage in which the $CO_2$ refrigerant, having released heat in the cooling stage, absorbs heat when the $CO_2$ refrigeration system is operating in cooling mode; $CO_2$ transfer lines connecting the compression stage, the cooling stage, the $CO_2$ reservoir and the evaporation stage, and wherein the $CO_2$ refrigerant is circulable in a closed-loop circuit; a heat line connecting the $CO_2$ reservoir to the evaporation stage for conveying a first portion of the flash gas from the $CO_2$ reservoir to the evaporation stage when the $CO_2$ refrigeration system is operating in heating mode, wherein the first portion of the flash gas releases heat in the evaporation stage for heating the evaporation stage; and a flash gas heat return line for conveying the flash gas having released heat in the evaporation stage from the evaporation stage to the $CO_2$ reservoir; and a pressure regulating unit provided in the flash gas heat return line, for pressurizing the flash gas having released heat in the evaporation stage.

BRIEF DESCRIPTION OF THE DRAWINGS

It will be noted that throughout the appended drawings, like features are identified by like reference numerals.

DETAILED DESCRIPTION

Figure 1:
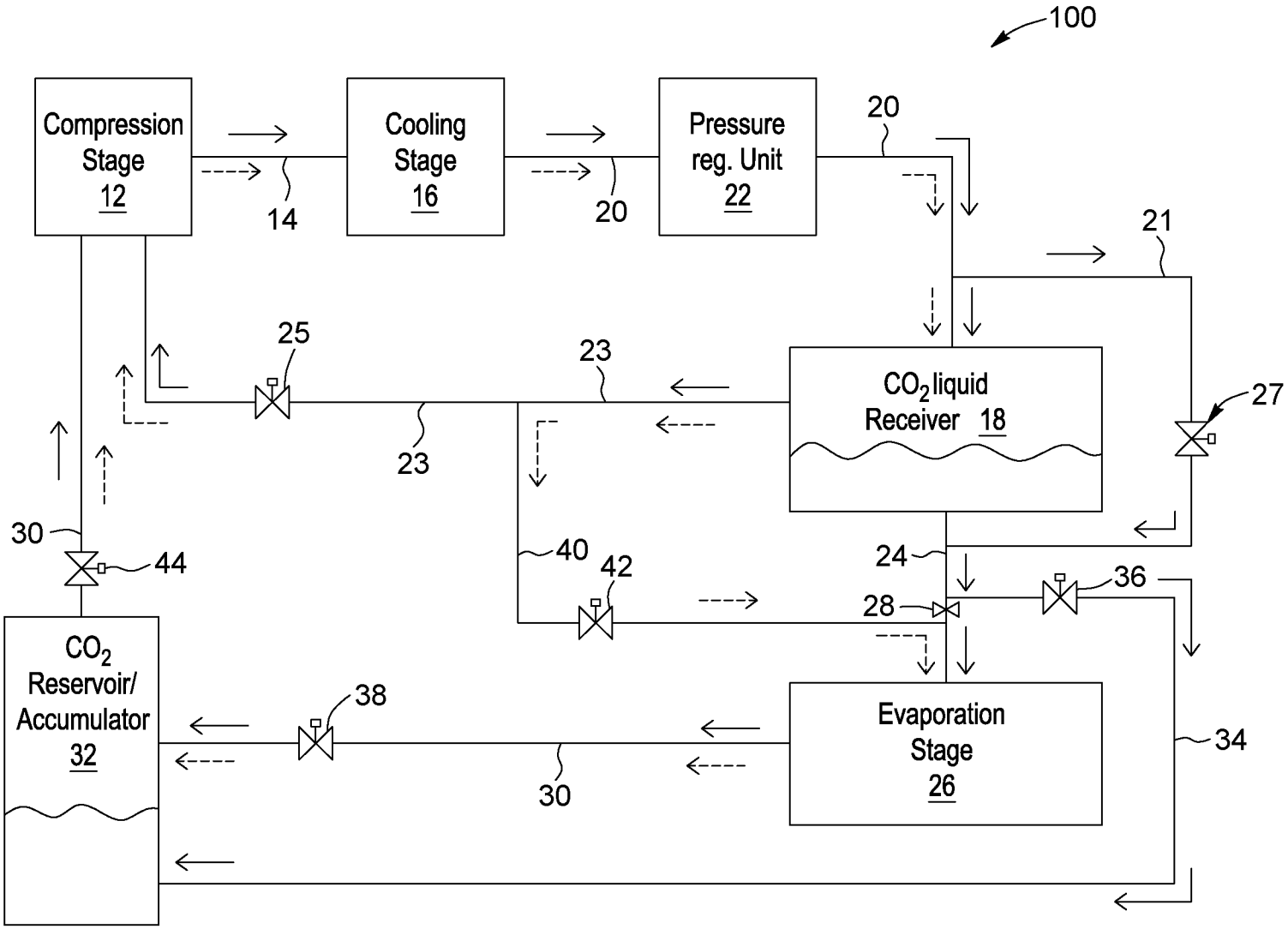
FIG. 1 is a block diagram of a refrigeration system including a defrost circuit, according to an embodiment.
Figure 2:
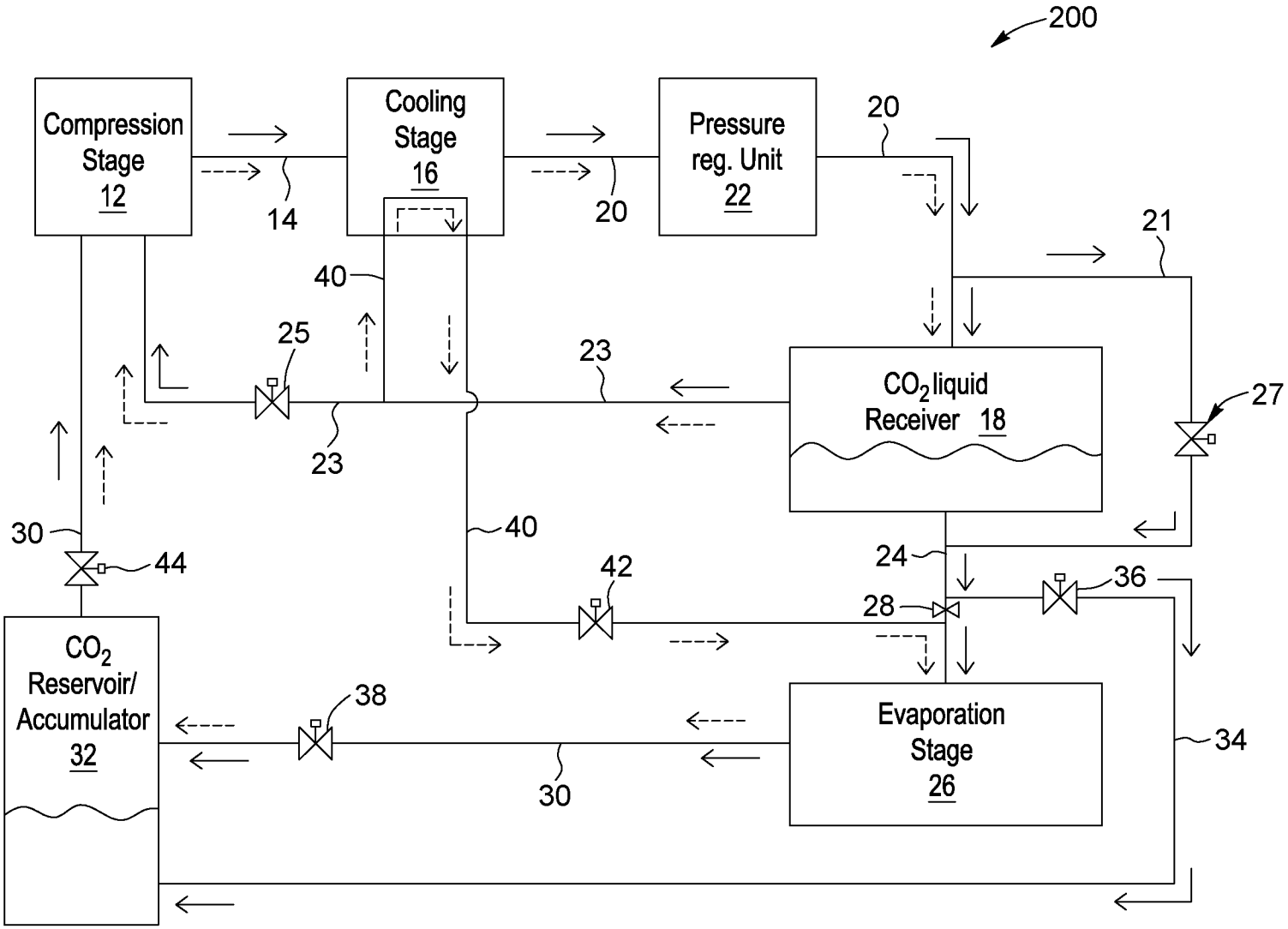
FIG. 2 is a block diagram of a refrigeration system including a defrost circuit, according to another embodiment wherein refrigerant is heated prior to flowing into evaporators in a defrost mode.

Referring to FIGS. 1 to 5, refrigeration systems 100, 200, 300, 400, 500 according embodiments of the present description are shown. It is understood that the refrigeration systems can for example be for refrigerating food products in a supermarket (e.g., a supermarket refrigerator or freezer, or a refrigerated room), or can be an air-conditioning system of the type used to cool rooms such as computer server rooms. Alternatively, the refrigeration systems can be of the type used to cool ice-playing surfaces including curling, hockey, and skating ice rinks.

The refrigeration systems 100, 200, 300, 400, 500 can operate in cooling mode and/or in defrosting mode, as will be further discussed below. In cooling mode, and when the refrigeration systems are for refrigerating food products, the refrigerant can for example be directed to medium-temperature refrigerated units (e.g., for non-frozen goods, such as meats or dairy) and/or low-temperature refrigerated units (e.g., for frozen goods). The defrosting mode is used in order to remove frost that can appear on the surface of the evaporators.

The refrigeration systems and methods described herein can be operated with $CO_2$ as the refrigerant. However, it should be understood that any other suitable refrigerant can be used, as would be known to a person skilled in the art.

Cooling Mode

Referring to FIGS. 1 to 5, The refrigeration systems 100, 200, 300, 400, 500 include a cooling circuit wherein refrigerant circulates when the refrigeration systems operate in a cooling mode. The cooling circuit is represented by solid line arrows in FIGS. 1 to 5. In a non-limitative embodiment, the refrigerant includes $CO_2$.

In some embodiments, the refrigeration system includes a compression stage 12 in which refrigerant in a gaseous state is compressed. In some embodiments, the compression stage 12 can include one or several compressors. In some embodiments, the compression stage 12 can include several compression sub-stages, each compression sub-stage including one or several compressors. It is understood that each compression sub-stage can pressurize refrigerant at the same pressure or at different pressures. In some embodiments, the compressors can be configured in a parallel configuration, wherein the incoming refrigerant flow is divided before being supplied to the compressors. The compressor outputs can then be recombined. In some embodiments, the compression stage 12 can include one or more compression units, each including one or more compressors, configured in a parallel configuration. Each one of the compression units can be fed with a different refrigerant flow. For instance and without being limitative, a first one of the compression units can be fed with refrigerant exiting an evaporation stage, a second one of the compression units can be fed with refrigerant exiting a liquid receiver, such as a condensation reservoir, and a third one of the compression units can be fed with refrigerant exiting a pressure-regulating unit. In some embodiments, the compression stage 12 is designed to compress refrigerant into a sub-critical state and/or a supercritical state (or transcritical state). For example, the compression stage 12 can include a first series of compressors for operation in the sub-critical state and a second series of compressors for operation in the transcritical state. The compression stage 12 will be described in more details below. However, it is appreciated that the refrigeration system can be designed to either operate solely in a sub-critical state, solely in a supercritical state, alternatively in both the sub-critical state and the supercritical state, or simultaneously in both the sub-critical state and the supercritical state.

In some embodiments, the refrigerant exiting the compression stage 12 is transferred to a cooling stage 16 in transfer line 14. It is understood that a transfer line can be a direct connection, such as a conduit or a pipe, between two adjacent components of the refrigeration system or a succession of connections between a plurality of components of the refrigeration system. In the cooling stage 16, refrigerant in a compressed state releases heat. In some embodiments, the cooling stage 16 includes a gas cooling stage (or gas cooler). The cooling stage 16 can include one or several cooling units which can be disposed in parallel and/or in series and/or in cascades. In some embodiments, in addition to or in replacement of the gas cooling stage, the cooling stage 16 can include a heat reclaim stage or a heat transfer stage, wherein heat is reclaimed from refrigerant by heating a fluid, such as air, water, or another refrigerant, or by heating equipment. The cooling stage 16 can include one or several heating units. Valve(s) can be provided in relation with the cooling stage units to control the amount of refrigerant directed to each of the cooling stage units.

In some embodiments, at least a portion of the refrigerant exiting the cooling stage 16 is transferred to a liquid receiver 18 in transfer line 20. In some embodiments, the refrigerant exiting the cooling stage 16 is transferred to the liquid receiver 18 in transfer line 20. In some embodiments, a pressure regulating unit 22, such as a valve, is positioned downstream of the cooling stage 16 and upstream of the liquid receiver 18. In the embodiment shown in the Figures, the pressure regulating unit 22 divides transfer line 20 into two sections. However, in alternative embodiments, the pressure regulating unit 22 can be mounted adjacent to one of the cooling stage 16 and the liquid receiver 18. The pressure regulating unit 22 can be any suitable valve or valve assembly that can maintain a pressure differential in line 20, i.e., that can maintain a higher pressure upstream thereof (the higher pressure side) than downstream thereof (the lower pressure side). In some embodiments, the refrigerant is compressed in a supercritical state and the refrigerant is returned to the liquid receiver 18 in a mixture of liquid and gaseous states. Alternatively, in some embodiments where the refrigerant is compressed in a sub-critical state, the refrigerant can be directly transferred from the cooling stage 16 to the condensation reservoir 18 without going through the pressure regulating unit 22 (i.e., by by-passing the pressure regulating unit 22). In other words, in some embodiments, the refrigeration system can be free of the pressure regulating unit 22 in line 20.

The liquid receiver 18 can accumulate refrigerant in a combination of liquid and gaseous states. Gaseous refrigerant accumulating in the liquid receiver 18 can be circulated back to the compression stage 12 in transfer line 23. More particularly, transfer line 23 can be used to direct flash gas to the compression stage 12. A pressure differential unit 25, such as a valve, can be provided in line 23 in order to control the refrigerant which is directed back to the compression stage 12 from the liquid receiver 18. transfer line 24 directs liquid refrigerant from the liquid receiver 18 to an evaporation stage 26 (e.g. a refrigerated counter or a refrigerated room when the refrigeration system is for refrigerating food products).

In some embodiments, the refrigerant exiting the cooling stage 16 can be transferred to the evaporation stage 26 without going through the liquid receiver 18. For example, in the embodiment shown in FIGS. 1 to 4, the refrigerant can by-pass the liquid receiver and be transferred directly to the evaporation stage 26 in transfer line 21. Transfer line 21 by-passes the liquid receiver and links lines 20 and 24. A pressure differential unit 27, such as a valve, can be provided in line 21 in order to control the refrigerant flowing in both paths (i.e., the refrigerant by-passing the liquid receiver 18 by going through line 21, or the refrigerant going through the liquid receiver 18 in line 20).

In some embodiments, the refrigerant can be expanded in an expansion device 28 (e.g., an expansion valve) prior to entering the evaporation stage 26. In the evaporation stage 26, the refrigerant cools a zone to be refrigerated, such as a counter, a sector of a refrigerated room or a surface. In some embodiments, the evaporation stage 26 can include one or several heat exchanger(s), such as a circuit of pipes, in which the refrigerant circulates to absorb heat from ambient air, from another fluid or from a solid. If refrigerant absorbs heat from ambient air, air can be propelled on the circuit of pipes through a fan, for instance to increase heat transfer (i.e., forced air convection).

In some embodiments, the refrigerant exiting the evaporation stage 26 is directed in transfer line 30 to the compression stage 12. In some embodiments, transfer line 30 includes an optional reservoir or accumulator 32. For example, the reservoir or accumulator 32 can be a suction line accumulator. In some scenarios, the suction line accumulator can prevent compressor damage from a sudden surge of liquid refrigerant and oil that could enter the compressor stage 12 from line 30. Transfer line 30 can be provided with a pressure regulating unit 38 (such as a valve) which can be configured in a closed position, or in an open position so as to let refrigerant through from the evaporator 26 to the accumulator 32.

In some embodiments, refrigerant can be directed from the liquid receiver 18 to the reservoir 32 in transfer line 34. In some embodiments, liquid receiver 18 can be by-passed, and refrigerant can be transferred directly from the cooling stage to the reservoir 32 via transfer line 21 and transfer line 34. Transfer line 34 can be provided with a pressure regulating unit 36 (such as a valve) which can be configured in a closed position, or in an open position so as to let refrigerant through from the liquid receiver 18 to the accumulator 32. In some embodiments (not shown), the reservoir 32 can be bypassed, such that the refrigerant is directly directed to the compression stage 12 from the evaporation stage 26 in line 30.

The pressure of refrigerant in the liquid receiver 18 is typically higher than the pressure of refrigerant in the reservoir 32. For example, the pressure of refrigerant in the liquid receiver 18 can be between 400 psi and 600 psi, or between 450 psi and 550 psi. For example, the pressure of refrigerant in the reservoir 32 can be between 300 and 400 psi. In some embodiments, the pressure of refrigerant in the liquid receiver 18 is variable and depends on the amount of refrigerant which is condensed and/or the amount of refrigerant which is fed into the liquid receiver 18. In some embodiments, the pressure of refrigerant in the reservoir 32 is maintained at a substantially constant value. For example, the pressure in the reservoir 32 can be set at a given value between 300 and 400 psi (e.g. 350 psi), and refrigerant can be allowed into the reservoir 32 from the evaporation stage 26 when the pressure drops below the given value (for example by opening pressure regulating unit 38 which can be mounted in transfer line 30, upstream of the reservoir 32). Similarly, when the pressure is higher than the given value, refrigerant can be forced out of the reservoir 32, for example by opening a valve 44 which can be mounted in line 30 downstream of the reservoir 32.

In some embodiments, the pressure differential between the liquid receiver 18 and the reservoir 32 can be leveraged for defrosting the evaporation stage 26 when the refrigeration system is operating in defrosting mode. In some embodiments, the pressure differential between the liquid receiver 18 and the reservoir 32 can be maintained when the refrigeration system is operating in defrosting mode. The defrosting mode is explained in further detail below.

Defrosting Mode

In most refrigeration systems, formation of frost typically occurs at the surface of the evaporator during the cooling cycle, and typically leads to degradation in cooling capacity. The frost can be completely or partially removed by switching the refrigeration system from the cooling mode to the defrosting mode.

Referring to FIGS. 1 to 5, the refrigeration systems 100, 200, 300, 400, 500 each include a defrost circuit wherein refrigerant circulates when the refrigeration system operates in defrosting mode. The defrost circuit is represented by dashed line arrows in FIGS. 1 to 5. Unless otherwise specified, it is understood that the refrigeration system is operating in defrosting mode throughout this section.

Still referring to FIGS. 1 to 5, in some embodiments, as the defrosting mode is switched on, the flow of liquid refrigerant flowing from the liquid receiver 18 to the evaporation stage 26 in transfer line 24 can be stopped, and refrigerant from the liquid receiver 18 can be used for defrosting the evaporation stage 26. The refrigerant used for defrosting, from the liquid receiver, can be flash gas or liquid refrigerant, or a combination thereof. Refrigerant from the liquid receiver 18 can be directed to the evaporation stage 26 via transfer line 40. Transfer line 40 can be branched from transfer line 23, as shown in FIG. 1 or can alternatively directly originate from the liquid receiver 18 (not shown). In some embodiments, transfer line 40 can transfer refrigerant from the liquid receiver 18 to transfer line 24 (for example downstream of the expansion device 28), or alternatively from the liquid receiver 18 directly to the evaporation stage 26. It is understood that when the refrigeration system is operating in defrosting mode, the evaporation stage 26 is a defrosting stage. In other words, the refrigerant directed to the evaporation stage 26 during the defrost cycle does not absorb heat for cooling the evaporator, but rather releases heat for melting the frost formed on the evaporator. It is therefore understood that in the context of the present description, evaporation stage and defrosting stage will be used interchangeably in reference to the defrost cycle.

In some embodiments, a flow control device 42 (such as a valve) is provided in transfer line 40 in order to control the flow of refrigerant which is directed from the liquid receiver 18 to the evaporation stage 26. It is understood that the flow control device 42 can be in closed position when the refrigeration system is operating in cooling mode so as to prevent the refrigerant from being sent to the evaporation stage. The flow control device 42 can then be switched to the open position when the refrigeration system is operating in defrosting mode. It is understood that the flow of liquid refrigerant in transfer line 24 can be stopped when the refrigeration system is operating in defrosting mode, and can be turned on when the refrigeration system is operating in cooling mode (for example using a flow control device—which can be provided in transfer line 24). Although the flow control device 42 and transfer line 24 are separate components than the evaporation stage 26 in the embodiments shown in the Figures, it should be understood that in other embodiments, the flow control device 42 and/or transfer line 24 can be part of the evaporation stage 26. The refrigerant transferred to the evaporation stage 26 heats the frost which has formed on the surface of the evaporator in order to defrost the evaporator, and can then be directed to the accumulator 32 via transfer line 30.

As explained above, the refrigeration system can be configured such that the pressure in the liquid receiver 18 is higher than the pressure in the accumulator 32 when the refrigeration system is operating in cooling mode. In some embodiments, when the defrosting mode is switched on, liquid refrigerant is prevented from flowing in line 24, and the refrigerant (e.g., refrigerant as flash gas, liquid refrigerant, or a combination thereof) from the liquid receiver 18 is discharged into the accumulator 32 via the evaporation stage 26 (where defrosting of the evaporator occurs) and via transfer lines 40, 30. The flow of refrigerant can then either be prevented from flowing further downstream of the accumulator 32, or alternatively be directed from the accumulator 32 to the compression stage 12. For example, this can be done by closing or opening an optional flow control device 44 (such as a valve) that can be provided in transfer line 30, downstream of the accumulator 32.

In some embodiments, the flow control device 44 is in closed position and the discharge of flash gas from the liquid receiver 18 to the accumulator 32 can occur until the pressure is equalized in the liquid receiver 18 and the accumulator 32. The cooling mode can then be switched back on, and can be set up such that a pressure differential is obtained between the liquid receiver 18 and the accumulator 32 once a continuous regime is reached. The defrosting mode can then be switched back on if need be (i.e., if frost is still present in the evaporator).

In alternate embodiments, the flow control device 44 is in open position, and the discharge of flash gas from the liquid receiver 18 to the accumulator 32 can occur constantly. In such case, excess gas in the accumulator 32 can be directed to the compression stage 12 via transfer line 30. The hot compressed gas exiting the compression stage 12 can then be transferred to the liquid receiver 18 via transfer lines 14, 20, after being optionally cooled in cooling stage 16.

Figure 3:
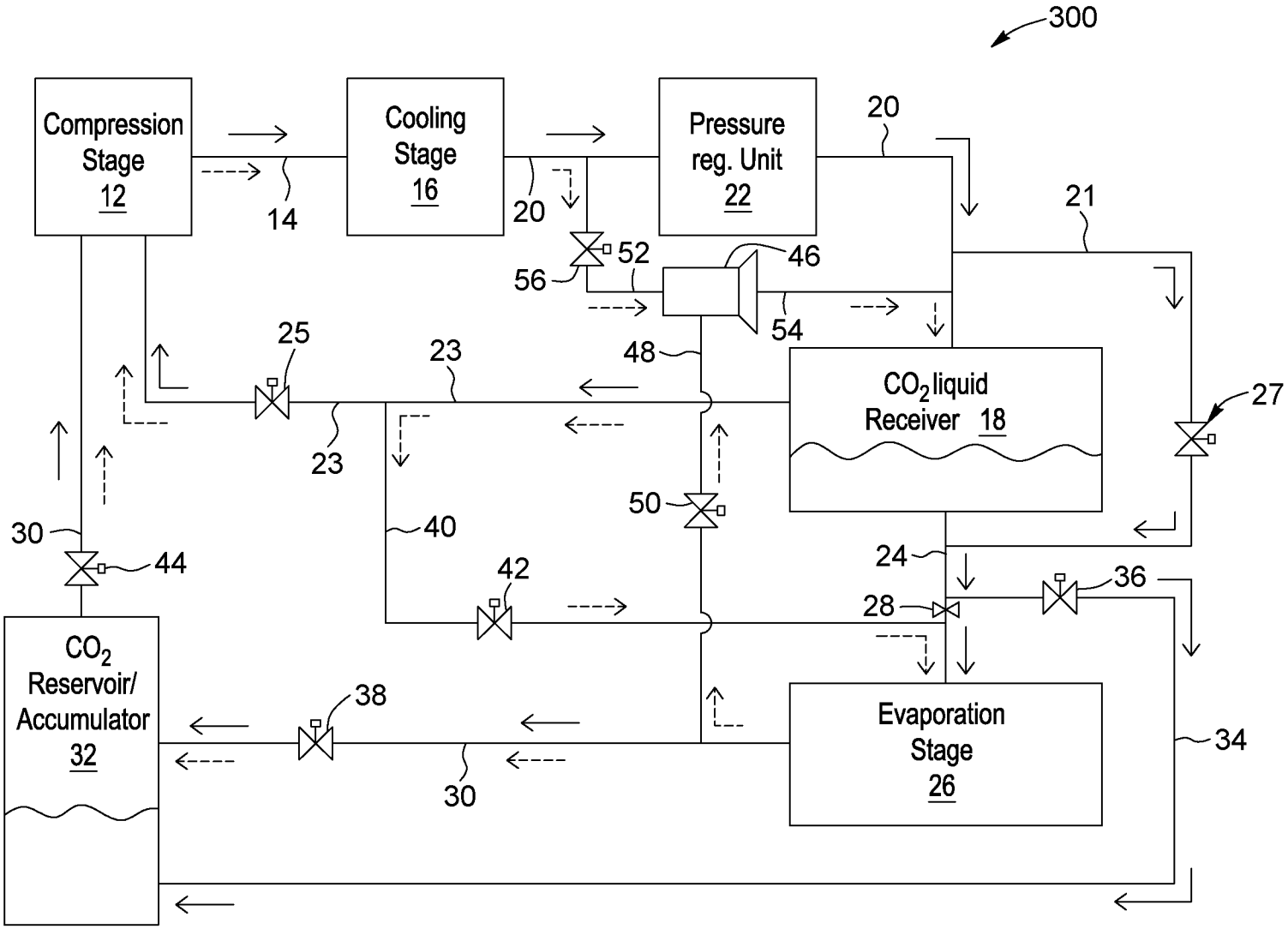
FIG. 3 is a block diagram of a refrigeration system including a defrost circuit having an ejector, according to another embodiment.
Figure 4:
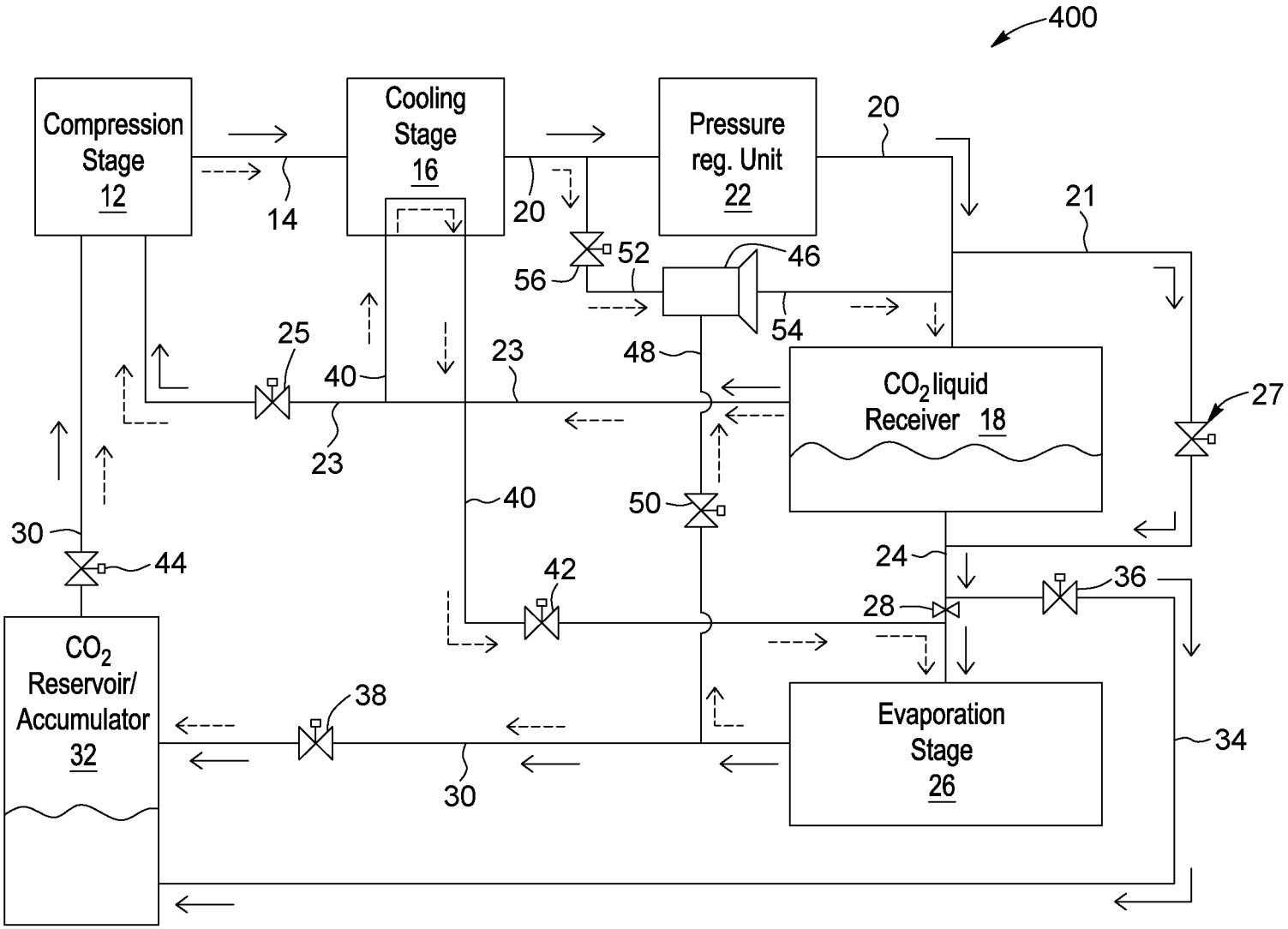
FIG. 4 is a block diagram of a refrigeration system including a defrost circuit having an ejector, according to yet another embodiment wherein refrigerant is heated prior to flowing into evaporators in a defrost mode.
Figure 5:
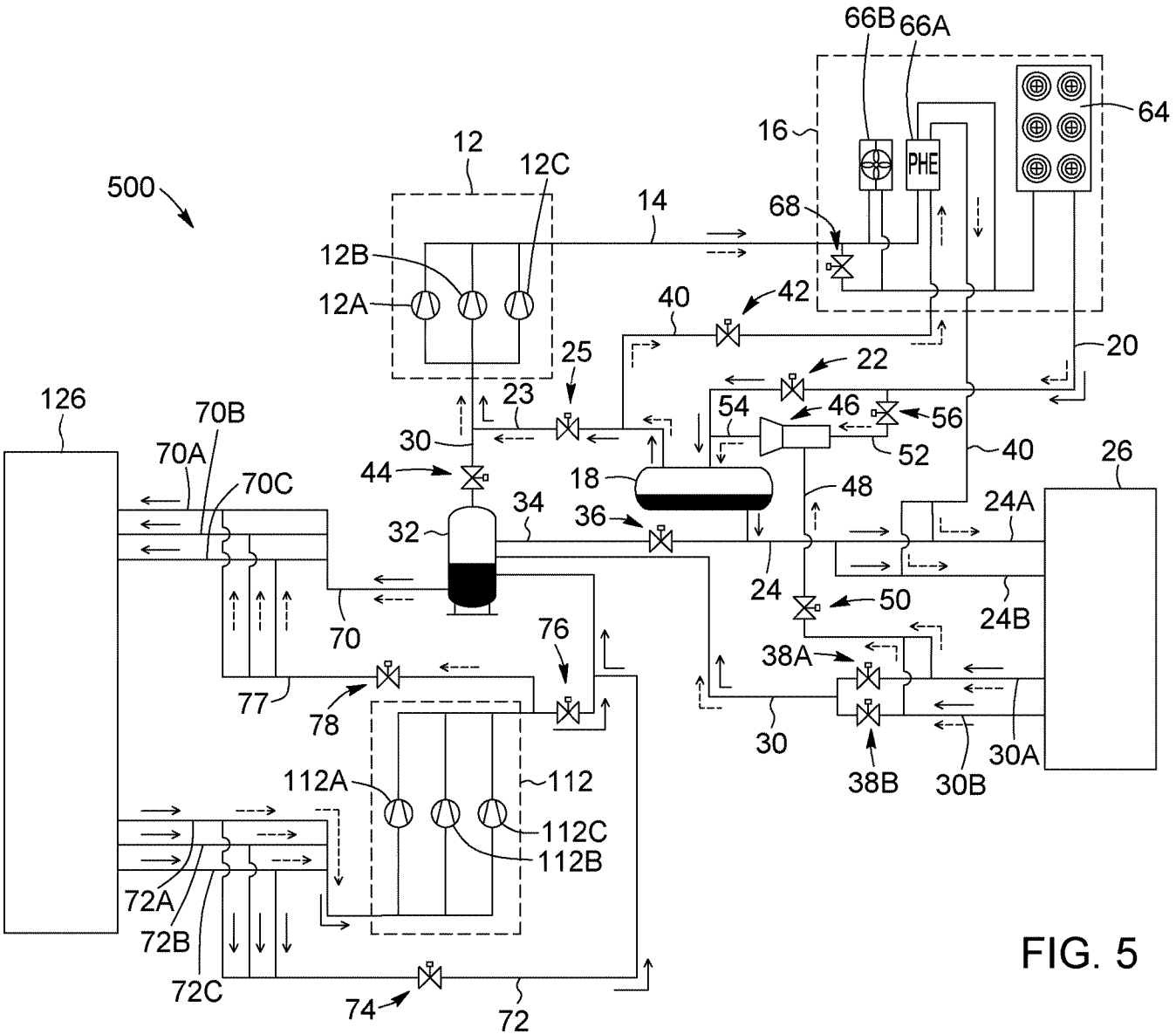
FIG. 5 is a technical plan of a refrigeration system including medium and high temperature evaporation stages each including a defrost circuit, according to yet another embodiment.

Now referring to FIGS. 3, 4 and 5, in some embodiments, an ejector 46 is provided upstream of the liquid receiver 18 in order to pressurize at least a portion of the refrigerant used for defrosting the evaporation stage 26. In the embodiment shown, at least a portion of the refrigerant used for defrosting the evaporation stage 26 is transferred to the ejector 46 via transfer line 48. A flow regulating unit 50 (such as a valve) can be provided in transfer line 48 in order to regulate the flow of refrigerant directed to the ejector 46. The ejector 46 can also receive compressed and cooled refrigerant via transfer line 52, and can then redirect compressed refrigerant into the liquid receiver 18 via transfer line 54. A flow regulating unit 56 (such as a valve) can be provided in transfer line 52 in order to regulate the flow of gas from the cooling stage 16 to the ejector 46. The flow regulating unit 56 can also prevent refrigerant from flowing through this path when the refrigeration system is operating in cooling mode.

In some embodiments, the flow of refrigerant exiting the evaporation stage 26 after defrosting can be split between transfer line 48 and transfer line 30 such that a first portion of the refrigerant is directed to the ejector 46 and a second portion of the refrigerant is directed to the reservoir 32. Flow control devices 38, 50 can be operated in order to control the flow of refrigerant in lines 30 and 48, respectively.

In some embodiments, the flow of refrigerant exiting the evaporation stage 26 after defrosting is conveyed in the transfer line 48, without being conveyed towards the reservoir 32. In some embodiments, the reservoir 32 is not present in the system or the flow control device 38 is closed during defrosting. In such case, the refrigerant is directed to the ejector and sent back to the liquid receiver 18. The flow of refrigerant exiting the liquid receiver 18 can be split between the evaporation stage 26 via transfer line 40, and the compression stage 12 via transfer line 23 (for example by opening flow control device 25). In some scenarios, a first portion of the refrigerant is used for defrosting the evaporation stage 26 and a second portion of the refrigerant is sent to being compressed and cooled before being injected into the ejector 46 via line 52.

Figure 6:
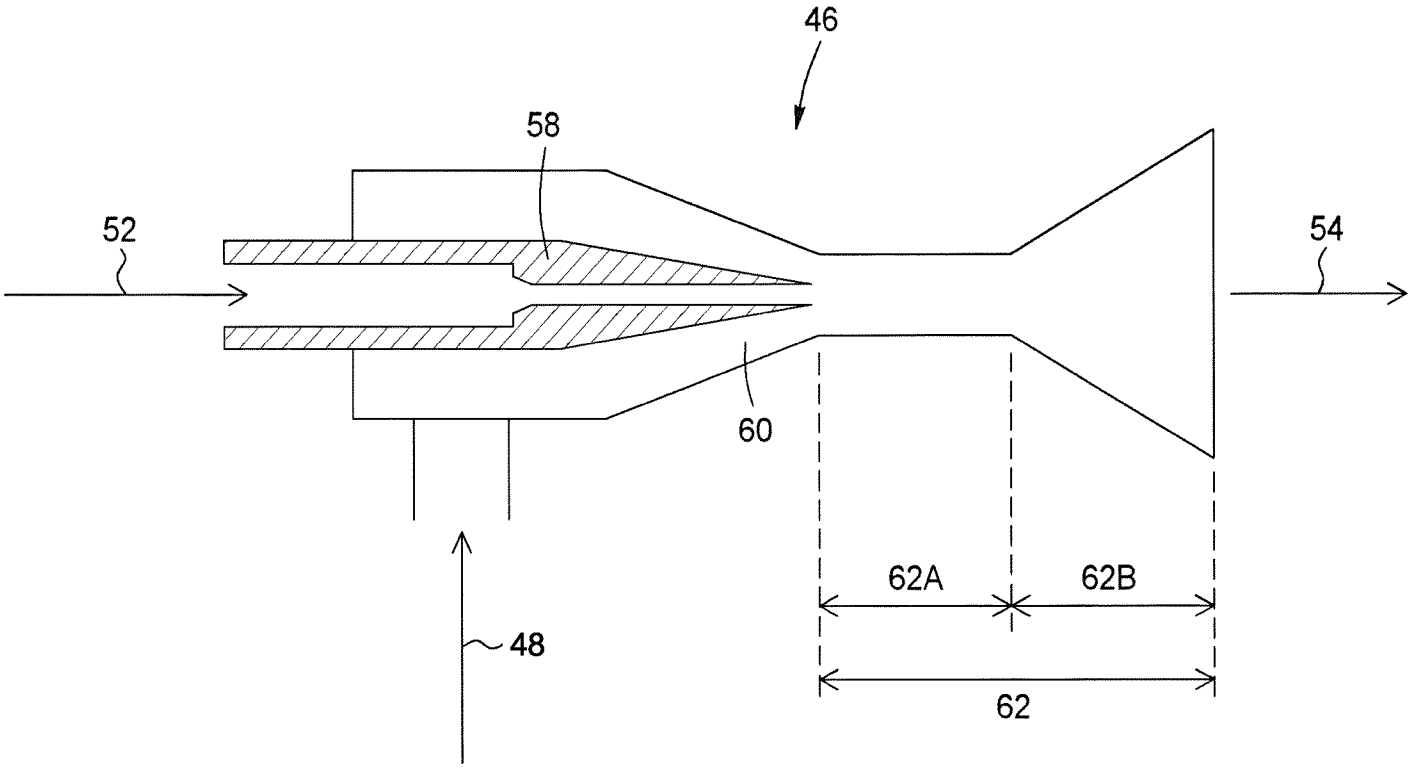
FIG. 6 is a cross-sectional schematic view of an ejector which can be used in the defrost cycle of the refrigeration systems shown on FIGS. 3 to 5.

Now referring to FIG. 6, one non-limiting example of an ejector 46 which may be used in the refrigeration system of FIGS. 3 to 5 is shown. In some embodiments, the ejector 46 can be configured to operate so as to receive compressed and cooled refrigerant via transfer line 52. Transfer line 52 is connected to a nozzle section 58 of the ejector, which acts as a decompressing means for reducing the pressure of refrigerant. The nozzle section 58 converts pressure energy into velocity energy to expand the refrigerant under reduced pressure. At the same time, a portion of the refrigerant used for defrosting and exiting the evaporation stage 26 can be suctioned into a suction port 60 of the ejector 46 via transfer line 48. At a downstream side of the nozzle section 58 and the suction port 60, the ejector 46 is provided with a pressurizing section 62 including a mixing section 62A and a diffuser section 62B. Refrigerant discharged from the nozzle section 58 is mixed with the refrigerant suctioned into the suction port 60 in the mixing section 62A and the pressure is increased in the diffuser section 62B. The diffuser section 62B is typically formed in such a shape that the area of the passage through which the gas flows is gradually increased. Therefore, the diffuser section 62B of the ejector 46 induces a deceleration of the flow of gas and increases the pressure by converting the kinetic energy of the gas into pressure energy. The pressurized refrigerant can then be transferred to the liquid receiver 18 via transfer line 54.

In some embodiments, the refrigerant can be heated during the transfer from the liquid receiver 18 to the evaporation stage 32. For example, transfer line 40 can be passed through one or more heat exchangers in order to heat the refrigerant transiting therein. In the embodiment shown in FIGS. 2, 4 and 5, transfer line 40 can absorb heat from compressed hot gas exiting the compression stage 12 and entering the cooling stage 16. It is understood that transfer line 40 can absorb heat from another source and that the heat exchanger may be external to the refrigeration system shown in FIGS. 2, 4 and 5.

In some embodiments, the refrigerant in liquid state that is remaining in the evaporation stage 26 and/or in the transfer lines between the liquid receiver 18 and the accumulator 32, can be flushed out of the refrigeration system as the refrigeration system is switched from the cooling mode to the defrosting mode.

It is understood that the refrigerant circulates in the refrigeration systems 100, 200, 300, 400, 500 mainly through the action of the compression stage 12. Check-valves (not shown) may be provided are provided in various transfer lines of the refrigeration system, in order to prevent refrigerant to be directed in an opposite direction. The check-valves are typically one-way valves which allow refrigerant circulation in a single direction.

In some embodiments, a portion of the refrigeration system can operate in cooling mode while another portion of the refrigeration system can operate in heating/defrosting mode.

Heating Mode

Referring to FIGS. 1 to 5, in some embodiments, the defrost circuit described herein can be used as a heating circuit for providing heat. When the heating circuit is used for providing heat without defrosting, the systems 100, 200, 300, 400, 500 are operating in a heating mode. The heating circuit is therefore also represented by the dashed line arrows in FIGS. 1 to 5. In the heating mode, the refrigerant from the liquid receiver 18 can be used for heating the evaporation stage 26. In other words, it should be understood that the heating mode operates in the same manner as the defrosting mode (where the refrigerant from the liquid receiver 18 is also used for heating the evaporation stage 26), with the exception that the heat provided is not necessarily used to defrost the evaporation stage. In should be understood that throughout the present description, the wording "defrosting mode" and "defrost circuit" can be switched to "heating mode" and "heating circuit" and can apply to occurrences where heat is provided to the evaporation stage but without necessarily defrosting the evaporation stage.

Refrigeration System with Medium and High Temperature Evaporation Stages

Now referring to FIG. 5, the refrigeration system 500 includes two evaporation stages 26, 126. The refrigeration system 500 can cool down food products in medium-temperature evaporator 26 (e.g., non-frozen food products) and can cool down food products in low-temperature evaporator 126 (e.g., frozen food products). Without being limitative, the refrigeration system 500 can for example be used in a supermarket, and the evaporators 26, 126 can be refrigerated rooms or refrigerated counters for holding food products. It is understood that other configurations and applications can be foreseen. The refrigeration system 500 can operate in cooling mode for cooling down food products or in defrosting mode for removing the frost which can form on the surface of the evaporators.

The refrigeration system 500 includes two reservoirs 18 and 32. The liquid receiver 18 is a condensation reservoir while the reservoir 32 is a suction accumulator. The liquid receiver 18 accumulates refrigerant in liquid and gaseous states. The suction accumulator 32 provides storage for the refrigerant directed to compression stage 12 from evaporation stage 26, and separation of the refrigerant in gaseous state from the refrigerant in liquid state occurs therein.

The refrigeration system 500 includes a first compression stage 12 in which refrigerant in a gaseous state is compressed by a plurality of compressors 12A, 12B, 12C mounted in parallel. The compressors are designed to compress refrigerant, and can compress refrigerant into a subcritical state or a supercritical state (or transcritical state). It is understood that other configurations can be foreseen. The refrigerant in gaseous state compressed in the compression stage 12 can be provided from either one of the two reservoirs 18 and 32, via transfer lines 23 and 30, respectively.

In the embodiment shown, the refrigerant exiting the compression stage 12 is transferred to the cooling stage 16 in transfer line 14 as compressed refrigerant in order to release heat. In the embodiment shown on FIG. 5, the cooling stage 16 includes a gas cooler 64 (used when the refrigerant is compressed in a supercritical state, and can operate as a condenser in subcritical state), and two heat reclaim units including plate evaporator 66A that can function in supercritical state and/or in subcritical state, as needed (can be used, for example when the refrigerant is compressed in a sub-critical state) and heat recovery ventilator 66B. In some embodiments, a flow control device 68 (such as a valve) can be provided in order to bypass the heat reclaim units 66A, 66B and be directly directed to the gas cooler 64 when the refrigerant is compressed in a supercritical state. It is understood that the configuration of the cooling stage 16 can vary. For example, the cooling stage 16 can include at least one of a gas cooler and a heat reclaim unit.

The refrigeration system 500 also includes a second compression stage 112 in which refrigerant is compressed by a plurality of compressors 112A, 112B, 112C mounted in parallel. The compressors 112 can compress refrigerant into a sub-critical state or a supercritical state (or transcritical state). It is understood that is the compressors 112 compress the refrigerant into a supercritical state, a gas cooling stage should be added downstream of the compression stage 112. In order to cool the evaporator 126, liquid refrigerant can be sent to the evaporator 126 from the accumulator 32 in transfer line 70. After having cooled the evaporator 126, the refrigerant can be returned directly to the reservoir 32 via line 72, or be compressed in compression stage 112 before being transferred to the reservoir 32. Flow control devices 74, 76 can be provided in transfer lines 72 and downstream of the compression stage 112, for respectively controlling the flow of refrigerant going through transfer line 72 and the compression stage 112. In order to defrost the evaporator 126, the hot compressed gas exiting the compression stage 112 can be directed to the evaporation stage 126 via transfer line 77, for example by opening flow control device 78 (i.e., defrosting of the evaporator 126 can be performed by hot gas defrost).

It is therefore understood that in some embodiments, the defrosting of the first evaporator 26 using flash gas (i.e., flash gas defrosting) can be used in conjunction to or in sequence to defrosting of the second evaporator 126 using hot gas defrost. It is also understood that in other embodiments, both evaporators 26, 126 can be defrosted using flash gas defrosting (not shown in the Figures), at the same time or in sequence.

Still referring to FIG. 5, the transfer lines feeding refrigerant to the evaporators 26, 126 and from which the refrigerant exits the evaporators 26, 126, can be split into a plurality of sub-lines. For example, transfer line 24 can be split into sub-lines 24A, 24B for feeding refrigerant to multiple sectors of the evaporator 26. Similarly, sub-lines 30A, 30B exiting the first evaporator 26 can merge into transfer line 30. Flow control devices 38A, 38B can be provided into sub-lines 30A, 30B, respectively. Transfer lines 70 and 72 can also be split into sub-lines 70A, 70B, 70C and 72A, 72B, 72C for feeding and recovering refrigerant from the second evaporator 126. More generally, it is appreciated that the refrigeration systems described herein can include several transfer lines extending in parallel or, in some embodiments, transfer lines can combine. For instance and without being limitative, in the evaporation stage 26, the circuit of pipes can combine into line 30 after exiting the evaporation stage 26 as shown in FIGS. 1 to 4. In alternative embodiments, the sub-lines can exit the evaporation stage 26 and combine outside of the evaporation stage 26 into a single transfer line 30 to deliver refrigerant directly to the reservoir 32 and/or the compression stage 12, as shown in FIG. 5. In other alternative embodiments, the sub-lines can exit the evaporation stage 26 without combining in a single line 30, and can instead extend in parallel to deliver refrigerant directly to the reservoir 32 and/or the compression stage 12 (not shown).

Method for Defrosting an Evaporator

In some embodiments, a method for defrosting a refrigeration system is provided. The refrigeration system can include a compression stage, a cooling stage, an evaporation stage, a first reservoir upstream of the evaporation stage in which the refrigerant is accumulated as liquid refrigerant and flash gas, and a second reservoir downstream of the evaporation stage.

When the refrigeration system is operating in cooling mode, the refrigerant is compressed in the compression stage; the refrigerant releases heat in the cooling stage; and the refrigerant having released heat in the cooling stage, absorbs heat in the evaporation stage.

In some embodiments, the method for defrosting the evaporator includes setting the pressure of refrigerant in the first and second reservoirs such that the pressure in the first reservoir is higher than the pressure in the second reservoir. In some scenarios, setting the pressure of refrigerant in the first and second reservoirs includes setting the pressure of flash gas in the first and second reservoirs. For example, when $CO_2$ is used as the refrigerant, the pressure of refrigerant in the first reservoir can be between 400 psi and 600 psi, or between 450 psi and 550 psi, and the pressure of refrigerant in the second reservoir can be between 200 and 400 psi, or between 300 and 400 psi. In some embodiments, the pressure in the first reservoir can be variable. For example, the pressure in the first reservoir can vary as a function of the amount of refrigerant which is condensed and/or the amount of refrigerant which is fed into the first reservoir. In other embodiments, the pressure in the first reservoir can be maintained at a substantially constant value. Similarly, in some embodiments, the pressure of refrigerant in the second reservoir can be variable, or maintained at a substantially constant value.

In some embodiments, the method further includes discharging at least a portion of the refrigerant (e.g., as flash gas) from the first reservoir to the second reservoir via the evaporation stage, wherein the refrigerant releases heat in the evaporation stage for defrosting the evaporator. In some embodiments, discharging at least a portion of the refrigerant (e.g., as flash gas) from the first reservoir to the second reservoir via the evaporation stage includes heating the at least a portion of the refrigerant from the first reservoir prior to entering the evaporation stage. In some embodiments, the heating of the refrigerant includes absorbing heat in a heat exchanger, which can be a heat exchanger of the cooling stage. In some embodiments, the heat exchanger can be provided downstream of the compression stage and downstream of the cooling stage.

In some embodiments, the method further includes pressurizing a first portion of the refrigerant (e.g., pressurizing flash gas) having released heat in the evaporation stage and directing the pressurized refrigerant back to the first reservoir. In order to be pressurized, the first portion of the refrigerant can be directed to a pressure regulating unit (e.g., an ejector) located upstream of the first reservoir. In some embodiments, the method further includes directing a second portion of the refrigerant having released heat in the evaporation stage, to the second reservoir.

In some embodiments, when the pressure regulating unit includes an ejector, the first portion of the refrigerant (e.g., flash gas) having released heat in the evaporation stage can be fed to a suction portion of the ejector. In some embodiments, the method includes pressurizing the first portion of the refrigerant (e.g., flash gas) having released heat in the evaporation stage by feeding the first portion of the refrigerant into the suction portion of the ejector and feeding compressed and cooled refrigerant from the second reservoir to a nozzle portion of the ejector.

In some embodiments, the method includes circulating the refrigerant in a closed-loop circuit between the compression stage, the cooling stage, the evaporation stage and the first and second reservoirs.

It will be appreciated that the method for defrosting the refrigeration system described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A refrigeration system operable in a cooling mode and a defrosting mode, the refrigeration system comprising:

a compression stage in which a refrigerant is compressed;

a cooling stage in which the compressed refrigerant releases heat;

a reservoir downstream of the cooling stage for storing the refrigerant;

an evaporation stage in which the refrigerant, having released heat in the cooling stage, absorbs heat when the refrigeration system is operating in the cooling mode;

transfer lines connecting the compression stage, the cooling stage, the reservoir and the evaporation stage, and wherein the refrigerant is circulable in a closed-loop circuit;

a defrost line connecting the reservoir to the evaporation stage for conveying a first portion of the refrigerant from the reservoir to the evaporation stage when the refrigeration system is operating in the defrosting mode, wherein the first portion of the refrigerant releases heat in the evaporation stage for defrosting the evaporation stage;

a defrost return line for conveying the refrigerant having released heat in the evaporation stage from the evaporation stage to the reservoir;

an ejector provided in the defrost return line and having a nozzle section, a suction section and a pressurizing section; and a flow regulating unit located downstream of the cooling stage and upstream of the nozzle section of the ejector;

wherein when the refrigeration system is operating in the defrosting mode:

the suction section receives refrigerant having released heat in the evaporation stage;

the nozzle section receives compressed and cooled refrigerant from the cooling stage, the refrigerant passing through the flow regulating unit; and pressurized refrigerant exits the ejector via the pressurizing section and is conveyed back to the reservoir; and wherein when the refrigeration system is operating in the cooling mode, the flow regulating unit prevents all the refrigerant from flowing between the cooling stage and the nozzle section of the ejector.

2. The refrigeration system of claim 1, wherein the refrigerant is stored in the reservoir as liquid refrigerant and flash gas.

3. The refrigeration system of claim 2, wherein the first portion of the refrigerant conveyed from the reservoir to the evaporation stage when the refrigeration system is operating in the defrosting mode, comprises at least part of the flash gas.

4. The refrigeration system of claim 1, further comprising a transfer line for conveying a second portion of the refrigerant from the reservoir to the compression stage, when the refrigeration system is operating in the defrosting mode.

5. The refrigeration system of claim 1, further comprising a discharge line connecting the evaporation stage to the compression stage.

6. The refrigeration system of claim 1, further comprising an second reservoir downstream of the evaporation stage for storing the refrigerant.

7. The refrigeration system of claim 1, wherein the flow regulating unit comprises a valve.

8. A $CO_2$ refrigeration system operable in a cooling mode and a defrosting mode, the CO2 refrigeration system comprising:

a compression stage in which $CO_2$ refrigerant is compressed;

a cooling stage in which the compressed $CO_2$ refrigerant releases heat;

a reservoir downstream of the cooling stage for storing the $CO_2$ refrigerant;

an evaporation stage in which the $CO_2$ refrigerant, having released heat in the cooling stage, absorbs heat when the $CO_2$ refrigeration system is operating in the cooling mode;

transfer lines connecting the compression stage, the cooling stage, the reservoir and the evaporation stage, and wherein the $CO_2$ refrigerant is circulable in a closed-loop circuit;

a defrost line connecting the reservoir to the evaporation stage for conveying a first portion of the refrigerant from the reservoir to the evaporation stage when the $CO_2$ refrigeration system is operating in the defrosting mode, wherein the first portion of the $CO_2$ refrigerant releases heat in the evaporation stage for defrosting the evaporation stage;

a defrost return line for conveying the $CO_2$ refrigerant having released heat in the evaporation stage from the evaporation stage to the reservoir;

an ejector provided in the defrost return line and having a nozzle section, a suction section and a pressurizing section; and a flow regulating unit located downstream of the cooling stage and upstream of the nozzle section of the ejector;

wherein when the $CO_2$ refrigeration system is operating in the defrosting mode:

the suction section receives $CO_2$ refrigerant having released heat in the evaporation stage;

the nozzle section receives compressed and cooled CO2 refrigerant from the cooling stage, the $CO_2$ refrigerant passing through the flow regulating unit; and pressurized $CO_2$ refrigerant exits the ejector via the pressurizing section and is conveyed back to the reservoir; and wherein when the refrigeration system is operating in the cooling mode, the flow regulating unit prevents all the refrigerant from flowing from the cooling stage to the nozzle section of the ejector.

9. The $CO_2$ refrigeration system of claim 8, wherein the $CO_2$ refrigerant is stored in the reservoir as liquid refrigerant and flash gas.

10. The $CO_2$ refrigeration system of claim 9, wherein the first portion of the $CO_2$ refrigerant conveyed from the reservoir to the evaporation stage when the $CO_2$ refrigeration system is operating in the defrosting mode, comprises at least part of the flash gas.

11. The $CO_2$ refrigeration system of claim 8, further comprising a transfer line for conveying a second portion of the $CO_2$ refrigerant from the reservoir to the compression stage, when the $CO_2$ refrigeration system is operating in the defrosting mode.

12. The $CO_2$ refrigeration system of claim 8, further comprising a discharge line connecting the evaporation stage to the compression stage.

13. The $CO_2$ refrigeration system of claim 8, further comprising a second reservoir downstream of the evaporation stage for storing the $CO_2$ refrigerant.

14. The $CO_2$ refrigeration system of claim 8, wherein the flow regulating unit comprises a valve.

* * * * *